United States Patent [19]

Fogel

[11] 4,145,780

[45] Mar. 27, 1979

[54] WATERBED ASSEMBLY

[75] Inventor: Isaac Fogel, Silver Spring, Md.

[73] Assignee: Classic Products Corporation, Beltsville, Md.

[21] Appl. No.: 880,470

[22] Filed: Feb. 23, 1978

[51] Int. Cl.[2] ..... H47C 27/08

[52] U.S. Cl. ..... 5/350; 5/370

[58] Field of Search ..... 5/349, 350, 368–370, 5/371; 137/574; 220/22

[56] References Cited

U.S. PATENT DOCUMENTS

| | | | |
|---|---|---|---|
| 3,732,585 | 5/1973 | Krehbiel | 5/370 |
| 3,736,604 | 6/1973 | Carson, Jr. | 5/366 |
| 3,840,921 | 10/1974 | LaBianco | 5/349 |
| 3,842,455 | 10/1974 | Whitney | 5/349 |

*Primary Examiner*—Casmir A. Nunberg

*Attorney, Agent, or Firm*—Eric P. Schellin; Anne M. Kornbau

[57] ABSTRACT

A waterbed assembly comprising a contoured frame, a waterbed mattress, and waterproof covers which completely seal the entire assembly. The contoured frame is structured to provide inwardly facing walls which dampen the water wave action normally associated with waterbeds. A plurality of internal baffles are positioned within the waterbed mattress to further dampen any wave action.

9 Claims, 8 Drawing Figures

WATERBED ASSEMBLY

BACKGROUND OF THE INVENTION

The present invention relates to an assembled waterbed construction and, more particularly, to an assembled waterbed construction which is distributed as a packaged unit wherein the waterbed frame and water filled mattress are constructed to provide a comfortable sleep surface.

In prior waterbed constructions the waterbed frame generally includes a platform or decking board surrounded by vertical walls forming a cavity for a nonstructured waterbed mattress. There is a waterproof liner which fits between the frame cavity and waterbed mattress. The waterbed mattress fills the cavity of the frame structure as shown in the waterbed constructions of U.S. Pat. Nos. 3,761,974, issued to Kass, and 4,015,299, issued to Tinnel.

Labianco, U.S. Pat. No. 3,840,921, and Alsbury et al, U.S. Pat. No. 3,742,531, disclose waterbed constructions of molded foam plastic having inclined vertical perpherial walls and a recessed surface forming a cavity. Wainstein, U.S. Pat. No. 3,456,270, also discloses a waterbed construction wherein the side walls are inclined.

Carson et al, U.S. Pat. No. 3,736,604, disclose a waterbed mattress with internal baffle dampers welded to the top inside surface. The purpose of the baffles is to dampen water wave action of the waterbed mattress. Labianco also discloses baffles in a waterbed mattress for the same purpose.

Each of the above waterbed constructions has been made in an attempt to overcome features of waterbeds which have detracted from waterbeds being more widely accepted. While some of the inherent problems of waterbeds have been recognized, these constructions have not completely overcome the problems they intended to solve.

One of the major considerations in purchasing a waterbed has been the distributive weight factor of a water filled mattress. The weight of a king size waterbed of standard construction may be as much as 2,000 pounds. Many buildings are not designed to support this much weight on a relatively small floor space. Alsbury, et al, and Tinnel, cited above, have to some degree solved the weight problem by replacing the ordinary water filled mattress with a smaller water filled mattress and by including an increased amount of foam padding in the frame construction.

Another consideration in purchasing a waterbed is whether the assembly will be difficult to set up once it has been delivered and whether the assembly is waterproof. While packaged assemblies have not been a subject for patenting in the past, Alsbury, et al, and Tinnel do show waterbed constructions that could be distributed as a packaged unit; however, they do not afford maximum protection against water leakage.

A third consideration is personal comfort. One universal problem with waterbeds is the water wave action created by a person's movement. As a person moves, the water in the water filled mattress is displaced by the person's weight is setting up a transverse wave action. The wave strikes the frame structure and is returned transversely. This type of wave action creates a rolling effect which has been known to make some users seasick and, in rare cases, users have actually been thrown out of a bed. Labianco attempts to overcome the wave action problem by including baffles joined to the top and bottom surfaces of the water filled mattress. The mattress is placed within the cavity formed by the inclined perpherial walls of a supporting frame with the periphery of the mattress resting on the peripheral top edge of the frame. The wave action is partially dampened by the baffles in the mattress and the inclined walls of the frame; however, some of the force of the wave is carried to the periphery of the mattress where it is returned transversely across the mattress, creating some wave action. Carson, as stated, shows baffles suspended from the interior top surface of a water filled mattress. The Carson arrangement is limited in that the water filled mattress extends above the frame structure and any secondary wave action will push against the unframed portion of the mattress where the mattress will bulge and the wave will subsequently rebound.

SUMMARY OF THE INVENTION

It is a primary objection of the present invention to provide a waterbed assembly which overcomes the foregoing shortcomings of the prior art devices.

It is an object of the present invention to provide a waterbed assembly which is constructed as a package for distribution.

It is another object of the present invention to provide a waterbed assembly which has a contoured frame to reduce the overall weight.

It is another object of the present invention to provide a waterbed assembly which has a frame construction for eliminating water wave action.

It is a further object of the present invention to provide a waterbed assembly which includes a water filled mattress having baffles for reducing water wave action.

Still a further object of the present invention is to provide a waterbed assembly which includes a package assembly with a contoured frame structure with inclined walls and a water filled mattress having baffles where the assembly is of a reduced weight and substantially eliminates all water wave action.

According to the invention, there is provided a waterbed frame construction defining perpherial inclined walls and a recessed contoured foam mattress surface forming a cavity. The exterior of the frame is protected against water leaks by an outside terior of the frame is protected against water leaks by an outside cover and a liner. A water filled mattress with internal baffles is positioned within the perpherial inclined walls of the frame construction. With the mattress in position and not filled with water, a top protective cover is placed over the mattress and attached to the frame cover so that the waterbed assembly may be shipped. Once the assembly has reached its final destination, the top protective cover is partially removed and the mattress is filled with water, and the top protective cover is replaced to seal the waterbed assembly against leaks.

The contour of the recessed foam mattress is structured to reduce the amount of water used to fill the waterbed mattress. Another feature of the contoured foam mattress is that the foam mattress prevents what has come to be known as "bottoming". Bottoming occurs when a person either sits or lies on a waterbed. The person's weight causes the water to be displayed with the result that the person's body comes into contact with the surface under the waterbed mattress which is usually a hard decking surface. With the foam mattress of this invention the effect of bottoming is eliminated since a person does not contact a hard decking surface.

The improved internal baffles of this invention substantially eliminate any water action in a water filled mattress. This is due mostly to joining the baffles to the bottom interior surface of the water filled mattress and incorporating flotation elements in the top edges of the baffles. In this manner the baffles are maintained in almost constant contact with the interior top surface to block any wave action.

DESCRIPTION OF THE PREFERRED EMBODIMENT

Figure 1:
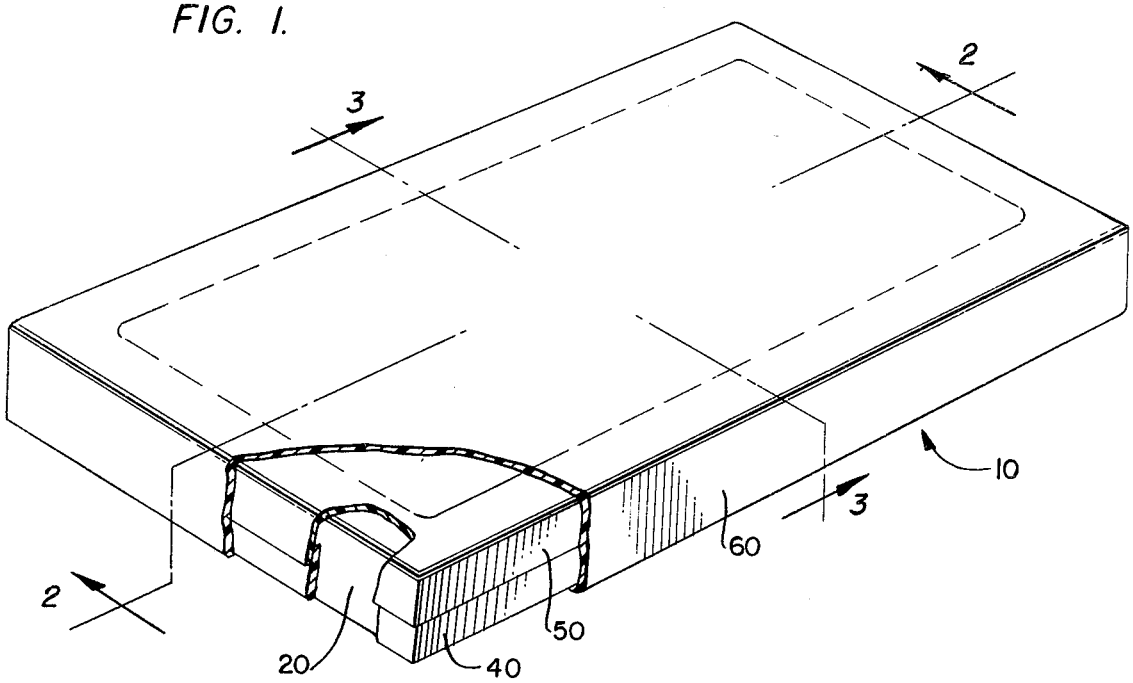
FIG. 1 is a perspective view of a waterbed assembly of the invention.

Referring to FIG. 1 there is shown a waterbed assembly 10 comprising a foamed plastic frame 30 encompassed by an outside lower cover 40, and an inside liner 50. An outside upper cover 60, covers a water filled mattress 70, shown in FIG. 2, and surrounds the peripheral top and sides of the foamed plastic frame 20.

Figure 2:
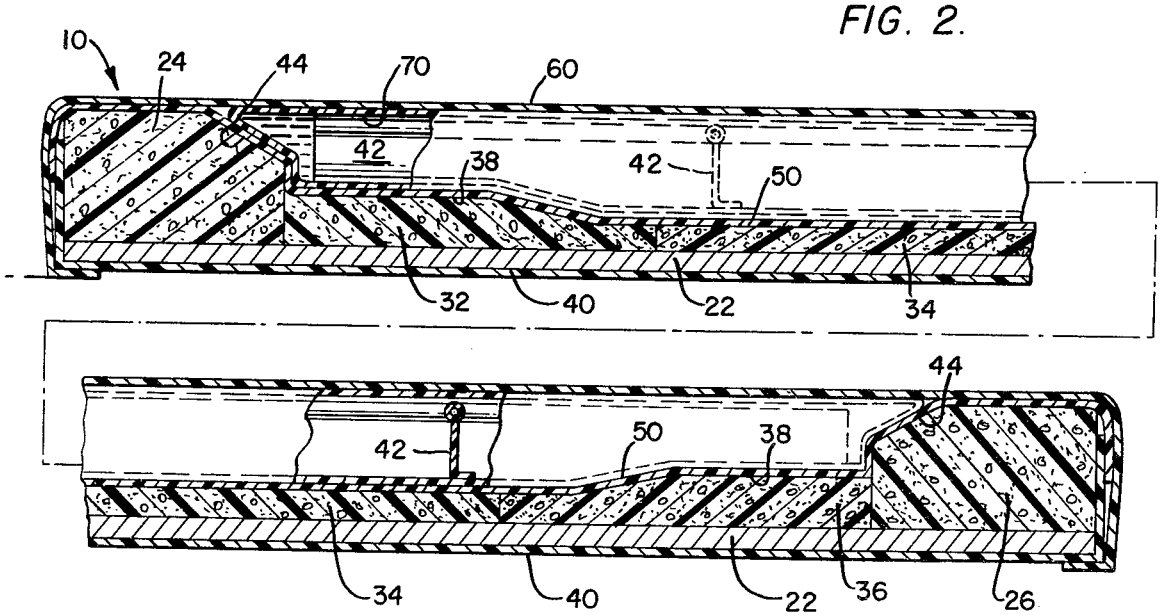
FIG. 2 is a cross section view along the line 2—2 of FIG. 1.
Figure 3:
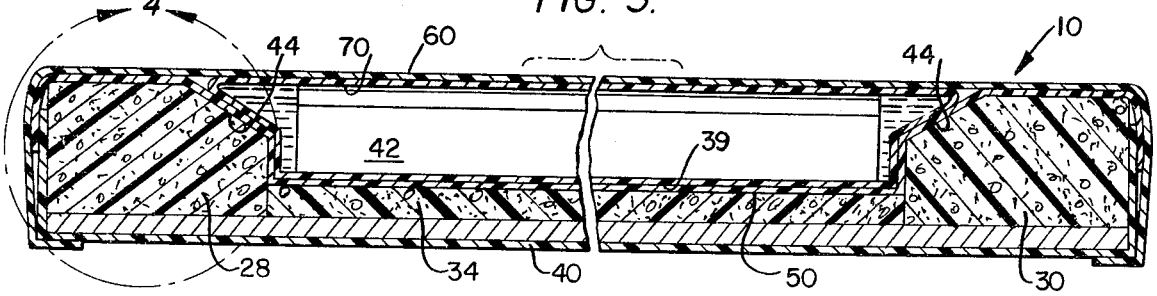
FIG. 3 is a cross section view along the line 3—3 of FIG. 1.

In FIGS. 2 and 3 the waterbed assembly 10 is shown in cross sectional views. The foamed plastic frame 20 includes a head rail 24, a foot rail 26, (FIG. 2), and side rails 28 and 30, (shown in FIG. 3). Each of the rails 24, 26, 28, and 30 has an inwardly facing inclined surface 44 and a peripheral top surface 43. The foamed plastic frame 20 is secured to the peripheral top surface edge of a decking panel 22 thereby forming a cavity or recess in which a plurality of foamed plastic mattress pads 32, 34, and 36 are adhesively secured to the decking panel. The mattress pads 32 and 36 have raised shelf areas 38 where one of the shelves is about 6 inches high to support a person's head and the other shelf is about 4 inches high to support a person's head and where both shelves are slightly higher than the mattress pad or pads 34. The purpose of the shelf areas 38 will be more fully explained in detail later.

The foamed plastic frame 20 is made of a high-density foam such as polyurethane, or some other relatively deformable material. The foamed plastic mattress pads 32, 34, and 36, on the other hand, are of a less-dense polyurethane or similar foamed plastic.

The decking panel 22 is a heavy duty corrugated cardboard, plywood, or some other relatively thin, light weight rigid material.

Once the foamed plastic frame 20 and the foamed plastic mattress pads 32, 34, and 36 are bonded to the decking panel 22, the outside lower cover 40, made of a waterproof vinyl plastic, or a similar waterproof plastic, is placed under the decking panel 22 and pulled up around the outside of the foamed plastic frame 20. In addition to forming a lower waterproof cover, the outside lower cover 40 closely fits around the rails of the foamed plastic frame 20, preventing the rails from bulging outwardly due to the weight of the water in the water filled mattress 70. It also has been found that the foamed plastic frame 20 bonded to the decking panel 22 will prevent the rails from bulging. This is because of the high-density foam used in the foamed plastic frame and the bond securing the rails to the decking panel 22. Using the outside lower cover 40 to prevent the rails from bulging is an added safety precaution in case a rail should pull loose from the decking panel 22, and, in addition, the tight fit of the lower cover will relieve some of the water pressure pushing on the rails.

An outside liner 50, also made of a waterproof vinyl plastic, or the like, is stretched over the foamed plastic mattress pads 32, 34, and 36 and wrapped over the rails of the foamed plastic frame 20 to overlap the upper edge of the outside lower cover 40, to form in cooperation with cover 40 a waterproof covering completely surrounding the foamed plastic mattress pads, the foamed plastic frame and the decking panel.

A waterbed mattress 70, of a vinyl plastic, with a fill valve, not shown, is placed on the inside liner 50 in the cavity formed by the foamed plastic frame 20 and the foamed plastic mattress pads 32, 34, and 36. The waterbed 70 includes a top wall 62 and a bottom wall 64. When the water bed mattress 70 is filled with water the top wall 62 is even with or slightly below the peripheral top surface 43 of the rails 24, 26, 28, and 30. This is important should the waterbed mattress 70 leak, in that the cavity formed by the frame 20 will hold all of the water since the inside liner 50 and the outside lower liner 50 are waterproof. Further, with the waterbed mattress completely within the cavity, the inclined surfaces 44 of the rails will better absorb water wave action since the water is confined by the frame 20.

Figure 4:
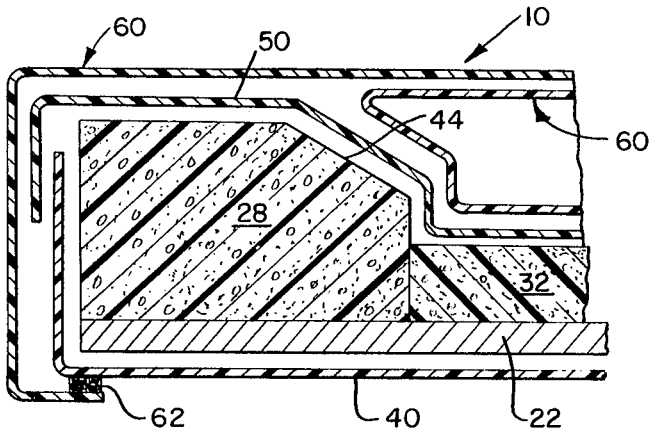
FIG. 4 is an exploded view of the circled section 4 of FIG. 3.

The top surface of the waterbed mattress 70 is covered by an outside upper cover 60, which is either a waterproof vinyl plastic sheet, as shown, or a filled mattress padding, not shown. The outside upper cover 60 is stretched over the waterbed mattress 70 and the top peripheral surfaces 43 of the rails and over the outside of the covered foamed plastic frame 20 to be attached to velcro strips 62 (FIG. 4) to the perimeter of the lower surface of the outside lower cover 40. The velcro strips 62, shown in FIG. 4, are well known in the art and include mating strips, one of which is bonded to the peripheral edge of the outside upper cover 60, and the other to the perimeter of the lower surface of the outside lower cover 40. If a waterproof cover is used it is advisable to use a mattress pad in addition to improve the comfort of the waterbed.

FIG. 4 shows a partial view of the assembled waterbed 10 of the invention with the various covers and the waterbed mattress 70 slightly separated to better show the relationship of the covers to one another. In summary, the outside lower cover 40 covers the outside surface of the decking 22 and the exposed outside walls of the rails where only rail 28 is shown. The inside liner 50 covers the mattress pads, pad 32 is shown, and the inclined surface 44 and peripheral top surface 43 of the rails to overlap the upper edge of outside cover 40. Once cover 40 and liner 50 are in place, the waterbed mattress 70 is placed in the cavity formed by the rails and the foamed plastic mattress pads. The assembly is completed by placing the cover 60 over the exposed surfaces of the waterbed mattress 70 and stretched over the frame 20.

The waterbed assembly 10 can be packaged for shipping or distribution by assembling the frame, the covers and the waterbed mattress as stated above without filling the mattress with water. Once the waterbed assembly 10 reaches its final destination the outside upper cover 60 is partially removed to expose the portion of the waterbed mattress 70 which includes the fill valve, not shown, for filling the water. After the waterbed mattress 70 is filled with water, the outside upper cover 60 is then replaced. The packaged waterbed assembly 10 of this invention makes it easier for the purchaser to set up the waterbed since it is delivered ready for use and not as a kit which has to be put together.

Figure 6:
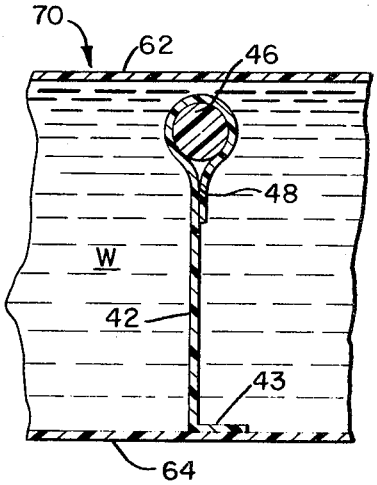
FIG. 6 is a cross section view along the line 6—6 of FIG. 5 showing a section of the mattress and a baffle of the invention.
Figure 5:
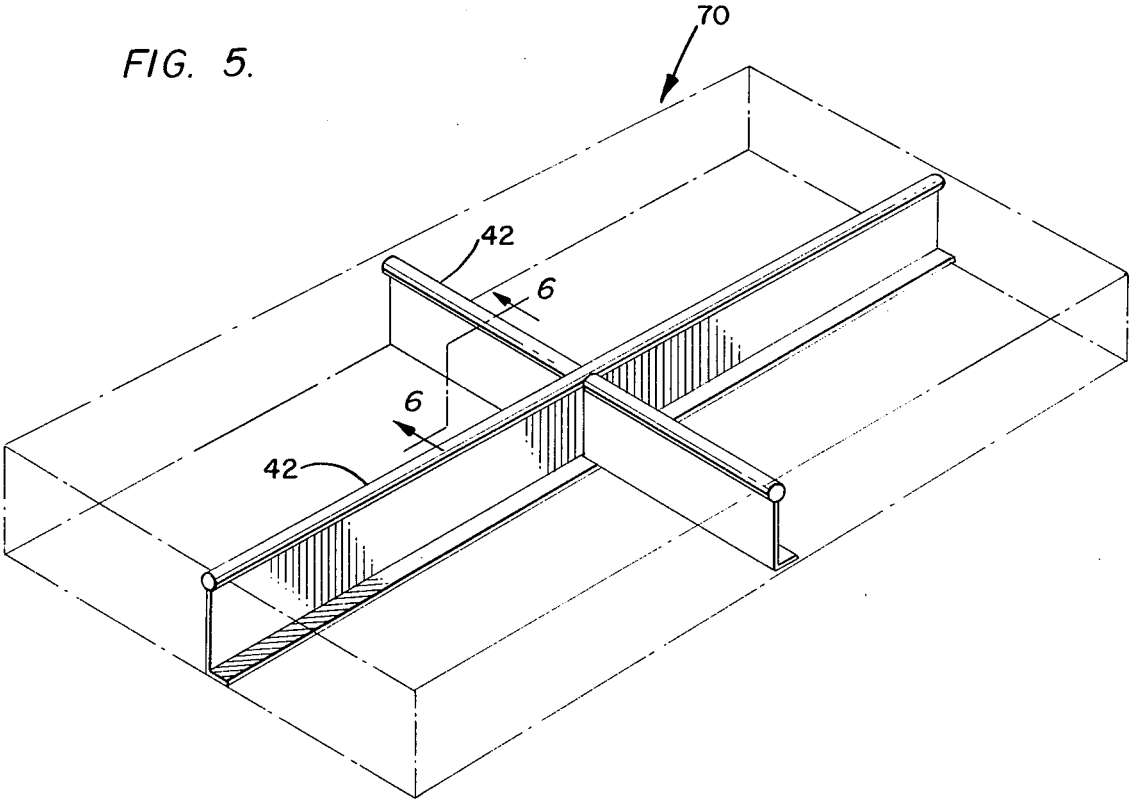
FIG. 5 is a perspective view of a baffle arrangement in the water filled mattress of the invention.

A water wave action baffle dampener 42 of the invention is shown in FIGS. 5 and 6 mounted in the waterbed mattress 70. In FIG. 6, a baffle dampener 42 in the form of a flexible plastic sheet is shown attached by thermal welds along lower bent edge 43 to the inside lower interior surface of the bottom wall 64 of the waterbed mattress 70. The baffle dampener 42 has a flotation rod 46, such as a foamed plastic rod, which is sealed in a pocket formed by wrapping the upper end of the plastic sheet around the rod 46 and thermally sealing along the edge 48. Since the flotation rod 46 floats in water, the baffle dampener 42 will extend the vertical distance between the interior top surface wall 62 and the interior bottom surface wall 64 of the water filled waterbed mattress. The baffle dampener shown in FIG. 6 is separated from the interior inside surface of the top wall 62, to more clearly show the various elements, namely, the baffle dampener 42, the top wall 62, and the bottom wall 64 of the waterbed mattress 70. In the preferred embodiment the baffle dampener 42 is in contact with the interior inside surface of top wall 62 to create a wiping action which has been found to be beneficial in preventing water wave action. Since wave action is created by a person's movements forcing the water transversely across the waterbed mattress, the baffle dampeners 42 achieve substantially complete dampening of the waves when in contact with the interior surface of the top wall 62, as described. This is because, as the waves push against the baffle dampeners 42, the dampeners flex in the direction of the wave force at a slow rate due to the flotation rods 46, thereby maintaining a wiping action against the interior surface of top wall 62. If the wave force is great enough there is a momentary slight separation of the baffle dampener 42 from the interior surface of top wall 62; however, the baffle dampener quickly recovers from the separation due to the floatation rod 46 to again form a wiping contact seal against further wave action.

While it is preferred to have the baffle dampener 42 in constant wiping contact with the interior surface of wall 62, wiping contact can be achieved by a person's weight forcing the top wall 62 downward against the baffle dampeners 42; therefore, it is possible to have a slight separation between the baffle dampener 42 and the interior surface of wall 62, as shown in FIG. 6.

Increased water wave action dampening is achieved by using the waterbed frame 20 of this invention with the waterbed mattress 70, as a unit as shown in FIGS. 2 and 3. As discussed, the rails 24, 26, 28 and 30 have inwardly facing inclined surfaces 44. These inclined surfaces 4 will greatly reduce any water wave action from hydrostatic pressure produced by a person's body motion. The force of the water striking the inclined walls 44 is absorbed by the walls and gently forced upward to thereby reduce the amount of force from the wave action repelled by the walls 44 back into the mattress. The water wave action is almost completely eliminated in the present waterbed assembly since the inclined walls 44 of the rails and the baffle dampeners cooperate to absorb any wave action.

Another aspect of the invention which helps to reduce water wave action is the contoured shape of the foamed plastic mattress pads 32, 34, and 36, which shape reduces the amount of water needed to fill the waterbed mattress 70. Obviously, if less water is used then the amount of water action is likewise reduced. This is particularly true when the contoured mattress pads are used in waterbed frame 20. The mattress pads 32 and 36 have raised shelf portions 38 to reduce the amount of water in those areas. If desired one of the shelf portions 38 can be higher than the other, in which case the higher one will be used under a person's head. Since a person's body weight is distributed mostly in his torso and legs, the deeper waterbed mattress supporting areas should be in these areas. The contoured mattress pads are structured to provide the proper water depths, in that pad or pads 34 are about one half as thick as the shelf portions 38 of pads 32 and 36.

Figure 7:
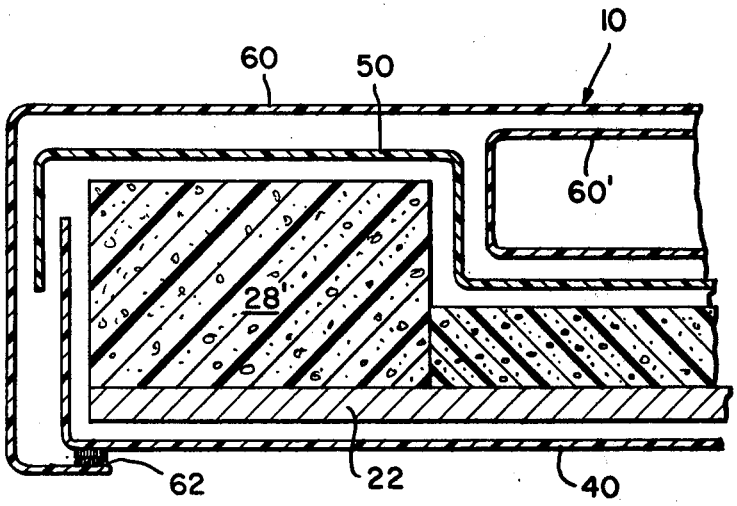
FIG. 7 is another embodiment of the invention showing an alternative exploded view of the circled section 4 of FIG. 3.

FIG. 7 shows another embodiment to the invention where rails 28 have straight interior walls. The waterbed mattress 60 is shown conforming to the rectangular surface formed by the rails 28 and the contoured mattress 32. In this embodiment the baffles 42, not shown, are the sole water wave absorbing means.

Figure 8:
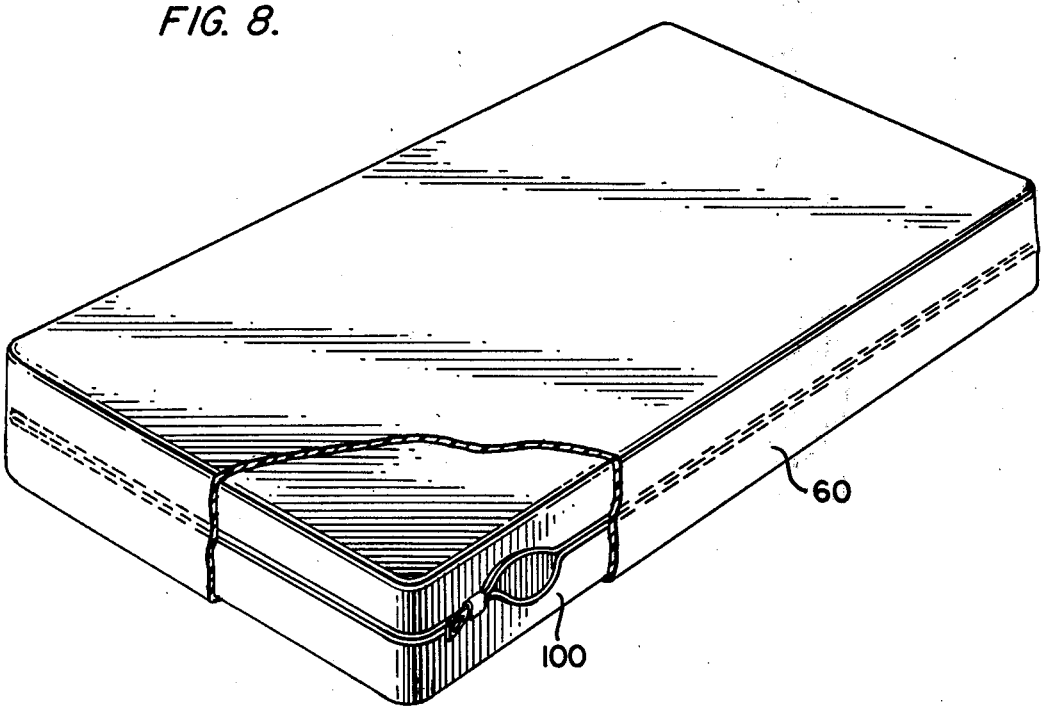
FIG. 8 is another embodiment of the waterbed assembly of the invention showing a partial view of a waterbed safety cover.

FIG. 8 shows another embodiment of the invention where the entire waterbed assembly is covered by an outer liner 100 of a waterproof plastic material which is the subject matter of applicant's copending application titled "Waterbed Assembly Safety Liner".

One of the advantages of the foamed plastic mattress pads of this invention is that they yield when a person first sits or lies on the waterbed mattress, providing a soft under surface with which a person will come in contact in case of "bottoming". This avoids the uncomfortable "bottoming" effect from contacting a hard decking board normally associated with many waterbeds.

Although only one specific form of the waterbed assembly has been described and illustrated in the drawings, it will be understood that various modifications and changes may be made by those skilled in the art without departing from the inventive concept. Reference should therefore be had to the appended claims for a definition of the scope of the invention.

What is claimed is:

1. A waterbed assembly comprising:

a flexible waterbed mattress comprising a top sheet and a bottom sheet;

a water wave dampening means in said waterbed mattress, said water wave dampening means extending vertically from the interior surface of said bottom sheet to the interior surface of said top sheet, where said dampening means are in wiping contact with said top sheet to dampen water waves;

a support frame having a cavity in which said waterbed mattress rests, said support frame having a rigid planar lower support, and peripheral support members which extend around the outer peripheral portion of said lower support member and at least one contoured foam plastic pad means on said planar lower support for supporting the said waterbed mattress;

said peripheral support members having a first pair of rails and a second pair of rails, said first pair of rails being longer than said second pair of rails, said first pair or rails and said second pair of rails having identical inwardly facing inclined walls for absorbing water waves.

2. A waterbed assembly as claimed in claim 1, wherein said support frame is covered by an outside lower cover and an inside upper cover, where said covers are constructed of a waterproof material.

3. A waterbed assembly as claimed in claim 2 wherein said contoured foam plastic pad means includes a first shelf portion, a recessed portion and a second shelf portion where said first shelf portion is higher then said second shelf portion and where a person's head is supported on said waterbed mattress above said first shelf portion.

4. A waterbed assembly as claimed in claim 3 wherein an outside cover means covers said waterbed mattress and the top and sides of said waterbed frame thereby forming a packaged assembly for shipping.

5. A waterbed assembly including a waterbed mattress and a waterbed frame for substantially eliminating water wave action comprising:

baffle dampener means in said waterbed mattress, said baffle dampener means being affixed to the bottom wall of said waterbed mattress and having flotation means for extending said baffle dampener means vertically to maintain a substantially constant wiping contact with the top wall of said waterbed mattress, and upstanding peripheral rails forming a cavity for said waterbed mattress, said upstanding peripheral rails being slightly higher than said waterbed mattress to confine said mattress within said waterbed frame and having inwardly facing inclined wall surfaces.

6. A waterbed assembly as claimed in claim 5 wherein said waterbed frame includes at least one contoured foamed plastic mattress pad, said pad having raised head and foot shelve portions and a recessed middle section.

7. A waterbed assembly as claimed in claim 6 wherein said support frame is covered by an outside lower cover and an inside upper cover, where said covers are constructed of a waterproof material.

8. A waterbed assembly as claimed in claim 7 wherein an outside top cover covers said waterbed mattress and the top and sides of said waterbed frame thereby forming a packaged assembly for shipping.

9. A water bed mattress having baffle damper means for substantially eliminating water wave action comprising:

a top sheet and a bottom sheet where said top sheet and said bottom sheet are joined to one another on their peripheral edges to form a sealed envelope; and baffle dampener means in said waterbed mattress, said baffle dampener means being affixed to the bottom sheet of said waterbed mattress and having flotation means for extending said baffle dampener means vertically to maintain a substantially constant wiping contact with the top wall of said waterbed mattress.

* * * * *